United States Patent [19]

Smock

[11] 4,307,270

[45] Dec. 22, 1981

[54] MOMENTARY SWITCH FOR A TIMING MECHANISM

[75] Inventor: Steven W. Smock, Indianapolis, Ind.

[73] Assignee: Emhart Industries, Inc., Indianapolis, Ind.

[21] Appl. No.: 223,820

[22] Filed: Jan. 9, 1981

Related U.S. Application Data

[63] Continuation of Ser. No. 33,974, Apr. 27, 1979, abandoned.

[51] Int. Cl.[3] ..... H01H 43/02

[52] U.S. Cl. ..... 200/38 R; 200/38 A; 200/38 F; 200/38 B; 200/153 LA

[58] Field of Search ..... 200/38 R, 38 A, 38 FA, 200/38 FB, 38 B, 38 BA, 153 L, 153 LA, 153 LB

[56] References Cited

U.S. PATENT DOCUMENTS

| | | | |
|---|---|---|---|
| 3,819,886 | 6/1974 | Homan et al. | 200/38 B |
| 4,146,760 | 3/1979 | Voland | 200/38 A |
| 4,246,454 | 1/1981 | Ray | 200/38 F |

*Primary Examiner*—James R. Scott

*Attorney, Agent, or Firm*—Robert F. Meyer; David W. Gomes

[57] ABSTRACT

A slider is actuated by an outer shaft of two cooperating inner and outer shafts to move the slider and close electrical contacts. The outer shaft is spring-biased with respect to the inner shaft such that after a momentary closing the outer shaft is returned to its original position to open the electrical contacts. A means is provided to impart a snap action of the outer shaft with respect to the inner shaft.

5 Claims, 5 Drawing Figures

MOMENTARY SWITCH FOR A TIMING MECHANISM

This application is a continuation of Ser. No. 33,974, 4-27-79, abandoned.

BACKGROUND OF THE INVENTION

Generally speaking, the present invention pertains to a timing mechanism wherein a cam means is carried by a shaft means and rotated to open and close electrical switches responsive to the rotation of the cam means, and wherein a snap acting momentary switch momentarily applies electrical power to the timing mechanism, the momentary switch comprising a slider carried by the timing mechanism and engaging electrical contact means, the shaft means including inner and outer coaxial shafts axially slideable with respect to each other, and coupling means coupling the shaft together for simultaneous rotation, ramp means carried by the outer shaft engaging the slider, a return spring engaging the inner and outer shafts, and snap action means carried by the inner and outer shafts providing a snap acting movement with respect to each other.

The present invention pertains to timing mechanisms and more particularly to a momentary switch momentarily applies power to the mechanism.

Timing mechanisms have been used for many years in appliances such as washers, dishwashers, and dryers. Such mechanisms are used to control the functions of the appliance in accordance with a program sequence. In most of such applications a momentary switch is used to momentarily apply electrical power to the timing mechanism until a complete program is initiated. In some applications, the momentary switch is separate from the timing mechanism and is part of the appliance itself. While for the most part such system is satisfactory, it would be better for ease of operation if the momentary switch were part of the timing mechanism itself.

OBJECTS OR FEATURES OF THE INVENTION

It is therefore a feature of the present invention to provide a timing mechanism having a momentary switch incorporated therein. Another feature of the invention is to provide such a momentary switch wherein a slider that is carried by the timing mechanism engages electrical contact means to close and open them. Another feature of the invention is to provide such a momentary switch wherein the slider is actuated by a shaft means which includes inner and outer coaxial shafts axially slideable with respect to each other. Another feature of the invention is the provision of a ramp means carried by one of the shafts which engages the slider. Another feature of the invention is to provide a snap action means carried by the two shafts to provide a snap acting movement of one of the shafts with respect to the other. These and other features of the invention will become apparent from the following description taken in conjunction with the accompanying drawings.

BRIEF DESCRIPTION OF THE DRAWINGS

FIG. 2A illustrates the indexed "in" position. FIG. 2B illustrates the original position.

DETAILED DESCRIPTION OF THE INVENTION

Figure 4:
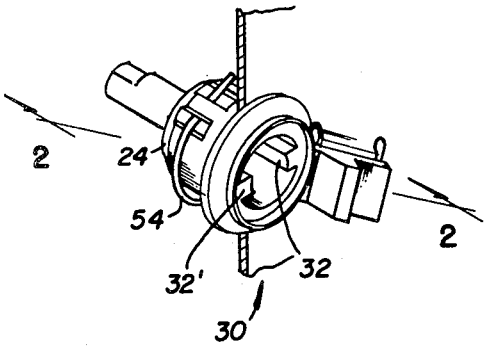
FIG. 4 is a view taken along the line 4—4 of FIG. 1.
Figure 1:
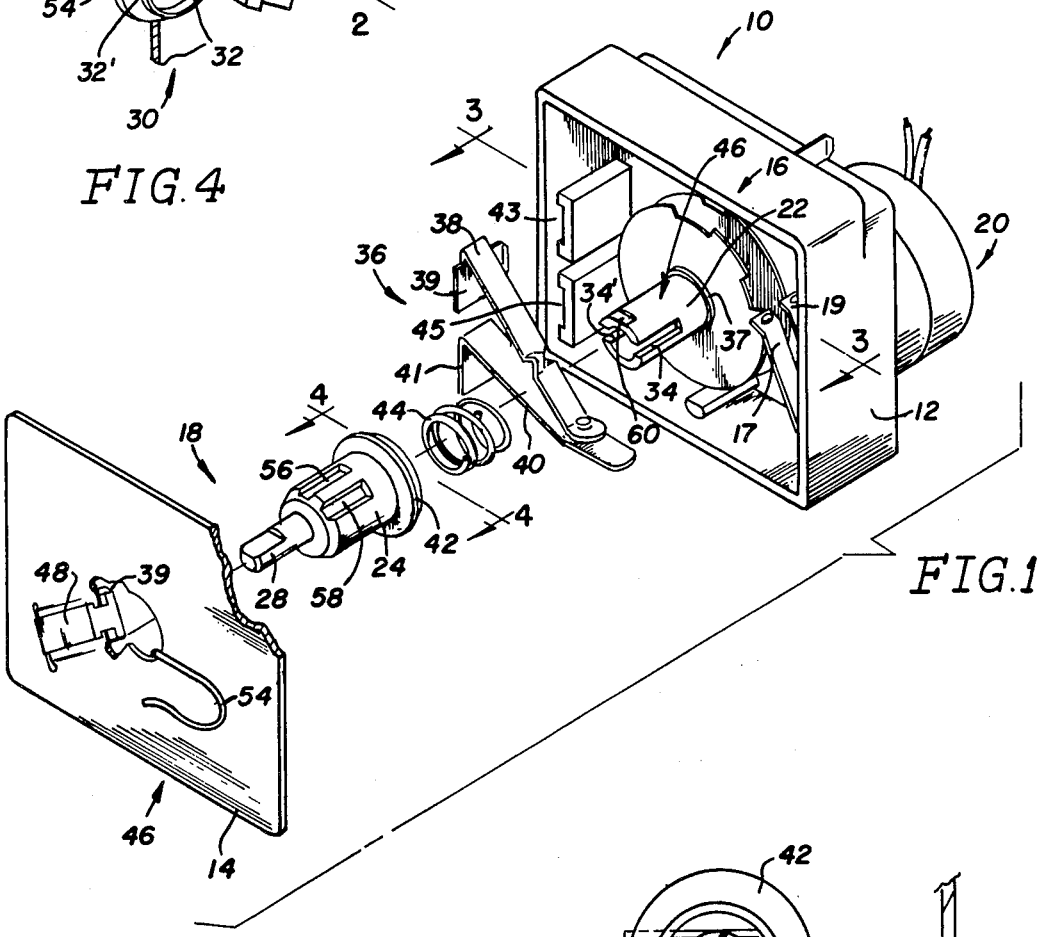
FIG. 1 is an exploded view of a timing mechanism employing the features of the invention.
Figure 3:
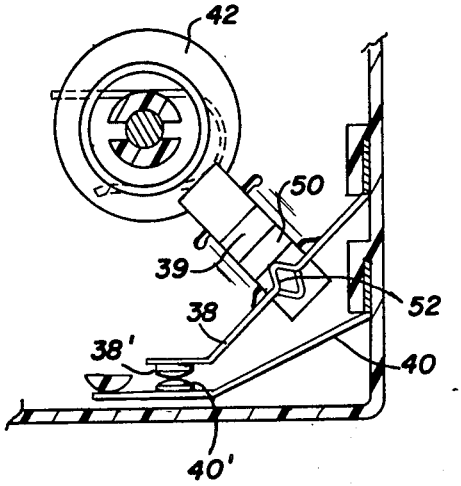
FIG. 3 is a view taken along the line 3—3 of FIG. 1.

Referring now to the drawings, there is shown a timing mechanism 10 which in general includes a housing 12 closed by a cover plate 14, a cam means 16 rotatably driven on a shaft means 18, and a motor drive means 20 which imparts power driven rotation to the cam means. Rotation of cam means 16 opens and closes electrical switches 17 and 19 in a manner well known in the art.

Shaft means 18 includes inner shaft segment 22 and outer shaft segment 24 which are coaxial with each other and are axially slideable with respect to each other. Inner segment 22 is fixedly carried on shaft 26 which is journalled in housing 12. Outer segment 24 is fixedly carried on shaft 28, the outer segment being journalled in end plate 14 and slideable with respect thereto. Thus, in the present embodiment, outer shaft segment 24 is axially movable. The two segments are coupled together for rotation together by a coupling means 30. Coupling means 30 includes an interlocking joint provided by webs 32 and 32' carried within the bore of the outer segment 24 and which engage slots 34 and 34' provided in inner segment 22. Thus manual rotation of shaft 28 or power driven rotation of shaft 26 will cause rotation of both the inner and outer segments.

According to the invention, there is provided a momentary switch 36 for momentarily applying electrical power to the timing mechanism. Momentary switch 36 includes a pair of switch blades 38 and 40 with their electrical contacts 38' and 40', inner and outer shaft segments 22 and 24, ramp surface 42 carried on outer segment 24, slider 39, return spring 44, and snap action means 46. Contact blades 38 and 40 are integral with electrical terminals 39 and 41 which are carried in casings 43 and 45 and which extend outside housing 12.

Return spring 44 is of the coil compression type and surrounds inner segment 22 and is biased between the outer segment 24 and collar 37 of the inner segment 22.

Figure 2A:
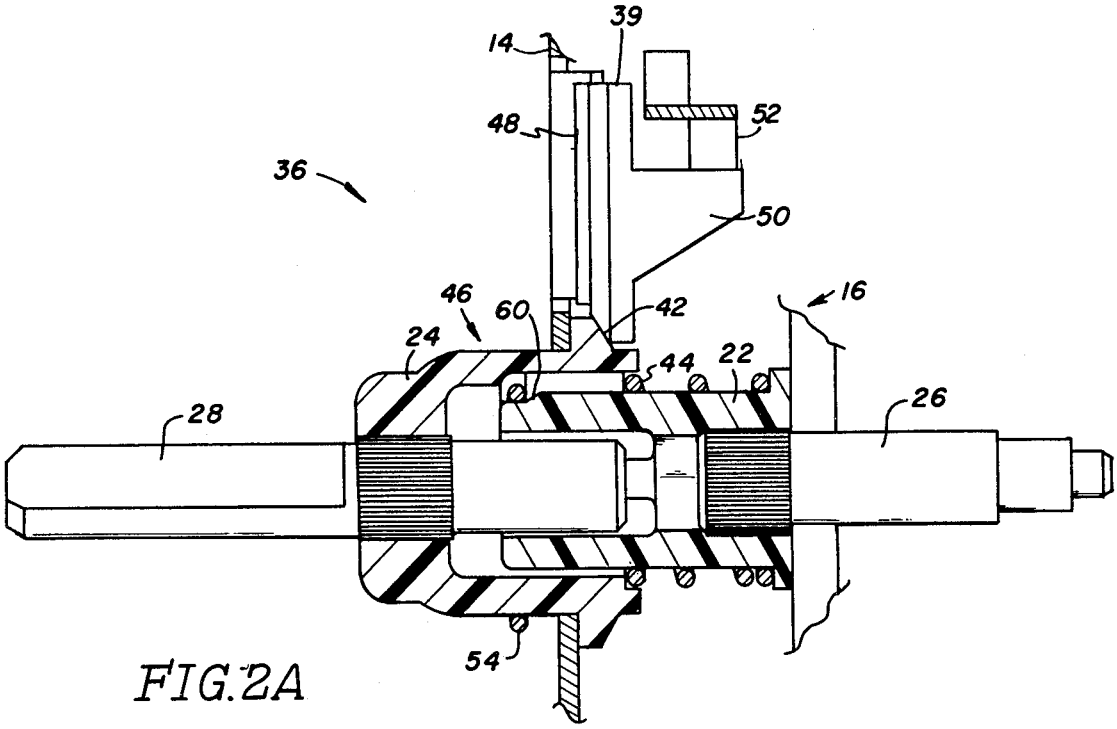
FIGS. 2A and 2B are views taken along the line 2—2 of FIG. 4.
Figure 2B:
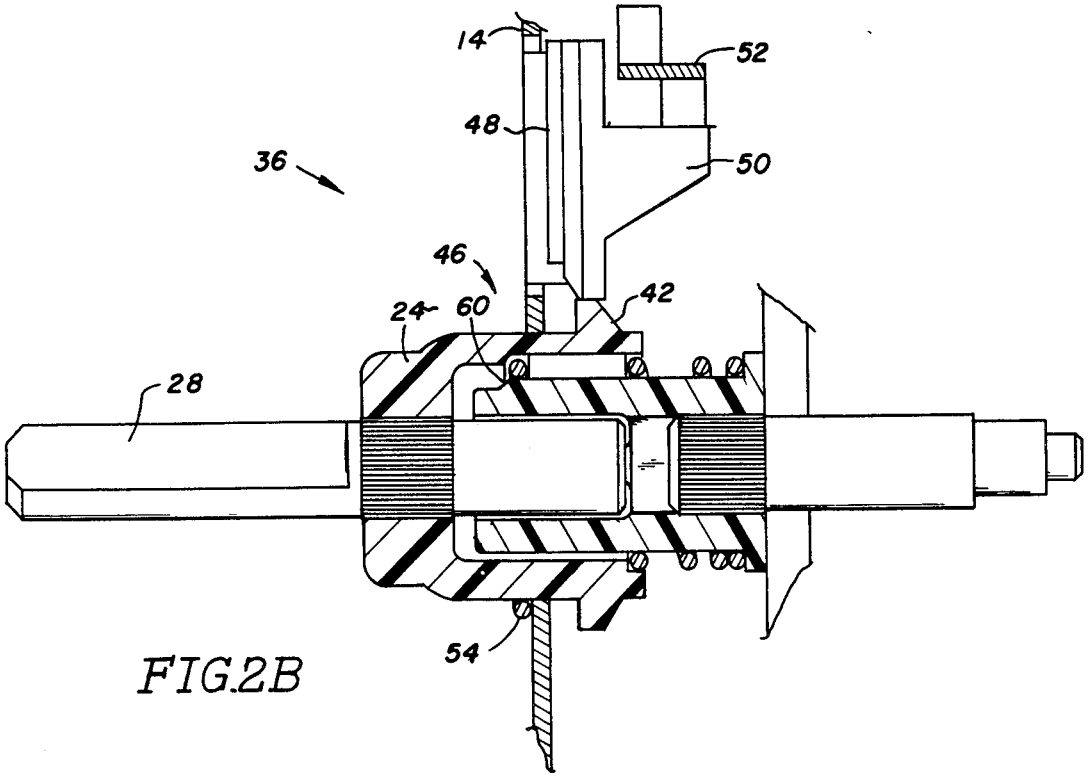

As shown in FIGS. 2A and 2B, slider 39 engages ramp surface 42 of the outer shaft segment 24 and slides in slot 48 of plate 14. Upon manual indexing of shaft 28, outer segment 24 is indexed "in" (FIG. 2B) to engage the ramp surface 42 with the slider 39 to cause lug 50 of the slider to engage follower 52 of contact blade 38 to close electrical contacts 38' and 40'. Upon manual release of the shaft 28 the outer shaft segment 42 will return to its original position, as shown on FIG. 2A, through the return coil spring 44.

A snap action is imparted to the outer shaft segment through snap action means 46. Snap action means 46 includes spring 54 which engages slots 56 and 58 of the outer shaft segment 24 and a ridge 60 carried on the inner shaft segment 22. Upon indexing the manual shaft 28 inwardly, spring 54 will snap over ridge 60 to impart the snap acting movement between the respective inner and outer shafts.

What is claimed is:

1. In a timing mechanism wherein a cam means carried by a shaft means is rotated to open and close electrical switches responsive to rotation of said cam means, a snap acting switch for momentarily applying electrical power to said timing mechanism comprising:

(a) a slider carried by said timing mechanism and engaging electrical contact means, (b) said shaft means including inner and outer coaxial shaft segments at least one of which is axially slideable with respect to the other and coupling means coupling said shaft segments together for simultaneous rotation, (c) ramp means carried by said one axially slideable segment engaging said slider, (d) a return spring engaging said inner and outer shafts segments, and (e) snap action means carried by said inner and outer shaft segment providing a snap acting movement with respect to each other whereby a manual indexing of said one axially slideable segment engages said ramp means with said slider to slide it into engagement with said electrical contact means, manual release of said slideable segment permitting same to return to its original position by said return spring.

2. In a timing mechanism according to claim 1 wherein said coupling means includes a cooperating interlocking joint carried by said inner and outer shaft segments.

3. In a timing mechanism according to claim 2 wherein said cooperating interlocking joint includes a web carried in a bore of said outer shaft segment and notches in said inner shaft segment engaging said web.

4. In a timing mechanism according to claim 1 wherein said return spring includes a coil compression spring carried between and engaging said inner and outer shaft segments.

5. In a timing mechanism according to claim 1 wherein said snap action means includes a ledge carried on said inner shaft segment and a spring carried by said outer shaft segment engaging said ledge.

* * * * *